US005709488A

United States Patent [19]

Imai et al.

[11] Patent Number: 5,709,488

[45] Date of Patent: Jan. 20, 1998

[54] PRINTER

[75] Inventors: Tatsuji Imai, Ichinomiya; Toshio Sugiura, Anjo; Takatoshi Takemoto, Nagoya, all of Japan

[73] Assignee: Brother Kogyo Kabushiki Kaisha, Nagoya, Japan

[21] Appl. No.: 777,051

[22] Filed: Dec. 30, 1996

[30] Foreign Application Priority Data

Jan. 18, 1996 [JP] Japan ..... 8-006558

[51] Int. Cl.[6] ..... B41J 33/52; B41J 33/14; B41J 35/08

[52] U.S. Cl. ..... 400/234; 400/236.2; 400/236; 400/208; 400/248

[58] Field of Search ..... 400/234, 236, 400/236.2, 223, 225, 227, 229, 232, 208, 120.01

[56] References Cited

U.S. PATENT DOCUMENTS

| | | | |
|---|---|---|---|
| 4,973,985 | 11/1990 | Genno et al. | 400/236.2 |
| 5,041,845 | 8/1991 | Ohkubo et al. | 400/236 |
| 5,051,011 | 9/1991 | Satoh et al. | 400/234 |
| 5,138,335 | 8/1992 | Sugimoto et al. | 400/236 |
| 5,294,203 | 3/1994 | Williams | 400/234 |
| 5,342,131 | 8/1994 | Nakajima et al. | 400/120.01 |
| 5,451,996 | 9/1995 | Awai et al. | 400/236 |
| 5,549,400 | 8/1996 | Tang et al. | 400/236 |

*Primary Examiner*—Eugene H. Eickholt
*Attorney, Agent, or Firm*—Oliff & Berridge

[57] ABSTRACT

A printer is capable of preventing the formation of creases in a portion of an ink ribbon corresponding to a print head and of printing characters and images in good print quality without forming streaks attributable to creases in the ink ribbon. A main frame supports a feed spool and a takeup spool so that an ink ribbon extends between the feed spool and the takeup spool. A print head support frame supporting a print head and an ink ribbon guide is supported pivotally at one end thereof on the main frame. When the print head support frame is locked in place on the main frame, the ink ribbon guide depresses the ink ribbon so that the tension of a portion of the ink ribbon on one side of the main frame is higher than that of a portion of the same on the other side of the main frame while the printer is in an unoperational state and tension is distributed uniformly across a portion of the ink ribbon corresponding to the print head while the printer is in an operational state. Thus, creases are not formed in the ink ribbon while the printer is in the operational state.

22 Claims, 8 Drawing Sheets

PRINTER

BACKGROUND OF THE INVENTION

1. Field of the Invention

The present invention relates to a printer employing an ink ribbon and, more particularly, to a printer capable of taking creases formed in the ink ribbon near a print head out of the ink ribbon in order to print clear characters not having streaks, which may be formed by creases in the ink ribbon.

2. Description of Related Art

A prior art thermal transfer printer using an ink ribbon prints desired images and characters on a plain paper sheet. As shown in FIG. 1, the thermal transfer printer has, as principal components, a sheet feed unit 40 and a print unit 50.

The sheet feed unit 40 has a paper cassette capable storing a stack of a plurality of recording sheets 41 and a feed roller 43 for separating the uppermost recording sheet 41 of the stack of recording sheets 41 contained in the paper cassette 42 from the other recording sheets 41 and sending the recording sheet 41 out of the paper cassette 42. The paper cassette 42 has a lifting plate 44 pivotally supported for swing motion on the bottom wall of the paper cassette 42 at one end thereof farther from the feed roller 43. A compression spring 45 extends between the bottom wall of the paper cassette 42 and the other end of the lifting plate 44 nearer to the feed roller 43. The lifting plate 44 supports the stack of recording sheets 41 thereon, and the compression spring 45 biases the lifting plate 44 upward to press the uppermost recording sheet 41 of the stack of the paper cassette 42 against the feed roller 43.

A pair of register rollers 46 supported for rotation are interposed on a sheet transport path between the sheet feed unit 40 and the print unit 50. The register rollers 46 adjust the timing of delivering the recording sheet 41 fed by the sheet feed unit 40 to the print unit 50 taking into consideration the printing operation of the print unit 50.

The print unit 50 has a thermal print head 51 provided with about 1600 heating elements arranged in a line on its front surface, an ink ribbon 52 formed by coating one surface of a base film with ink, and a cylindrical platen 53 supported for rotation.

A heatsink plate 54 of a metal for absorbing and dissipating heat generated for printing is attached to the back surface of the thermal print head 51. A compression spring 56 for pressing the thermal print head 51 against the platen 53 has one end connected to the back surface of the heatsink plate 54 and the other end connected to a ribbon guide 56. The ribbon guide 56 is formed by bending a plate and has a substantially U-shaped cross section. The ribbon guide 56 is disposed on a head frame so as to open downward. The ribbon guide 56 presses down the ink ribbon 52 at positions on the opposite sides of the thermal print head 51.

The ink ribbon 52 is unwound from a feed spool 57 and taken up on a takeup spool 58. The spools 57 and 58 are disposed with their rotation axes extended in parallel to the direction of arrangement of the heating elements of the thermal print head 51. The feed spool 57 is disposed above the thermal print head 51 with respect to an ink ribbon feed direction and the takeup spool 58 is disposed below the thermal print head 51 with respect to the ink ribbon feed direction. An unused portion of the ink ribbon 52 is wound on the feed spool 57. The ink ribbon 52 unwound from the feed spool 57 is nipped for printing between the thermal print head 51 and the recording sheet 41 pressed against the thermal print head 51 by the platen 53 and advances as the platen 53 rotates. The used portion of the ink ribbon 52 is taken up on the takeup spool 58.

A pair of delivery rollers 59 are disposed at a position below the thermal print head 51 with respect to the moving direction of the recording sheet 41 and below a path along which the ink ribbon 52 advances. The delivery rollers 59 feed the printed recording sheet 41 through the nip between the thermal print head 51 and the platen 53 outside from the printer.

FIG. 2 is a top view of the printer, in which the ribbon guide 56 is partly broken away so that the compression spring 55 pressing the heatsink plate 54 of the thermal print head 51 and the platen 53 are visible.

Four bearings 61A, 61B, 62A and 62B are mounted on a main frame 60. The shafts 57A and 57B of the feed spool 57 are supported in the bearings 61A and 61B, respectively, and the shafts 58A and 58B of the takeup spool 58 are supported in the bearings 62A and 62B, respectively.

An ink ribbon winding mechanism, i.e., a takeup spool driver, for winding the ink ribbon 52 on the takeup spool 58 is disposed at one side (left side as viewed in FIG. 2) of the main frame 60 near the takeup spool 58. The ink ribbon winding mechanism includes a platen driving motor 64 mounted on a support frame 63, a gear 58C mounted on the shaft 58B of the takeup spool 58, and a slip clutch 65 including a gear 65E in engagement with the gear 58C.

The slip clutch 65 has a gear 65A in engagement with a motor pinion 64B mounted on the output shaft 64A of the platen driving motor 64, a disk 65C, and a compression spring 65B having one end pressed against one side surface of the gear 65A and the other end pressed against the disk 65C. The gear 65A, the compression spring 65B and the disk 65C are arranged between a pair of plates 65C that rotate together with the gear 65E. The gear 65A and the disk 65C are supported so as to be able to rotate relative to the plates 65D, and are pressed against the plates 65D by the resilience of the compression spring 65B, respectively. When the gear 65A of the slip clutch 65 is driven for rotation, the rotation of the gear 65A is transmitted to the plate 65D pressed against the gear 65A or through the compression spring 65B to the plate 65D pressed against the disk 65C to rotate the gear 65E. When the torque for rotating the gear 65E increases beyond a predetermined torque, at least the gear 65A slips relative to the plate 65D and, consequently, the gear 65C can be rotated by a constant torque. Thus, the used ink ribbon 52 can be wound up on the takeup spool 58 without being slackened in synchronism with the rotation of the platen 53 that controls the feed of the ink ribbon 52 when the operating speed of the platen driving motor 64 is determined. So, the ink ribbon winding rate of the takeup spool 58 is always higher than the ink ribbon feed rate of the platen 53. Accordingly, the ink ribbon 52 can be wound by a constant torque even if the diameter of a coil of the ink ribbon 52 wound on the takeup spool 58 increases with the increase of the length of the ink ribbon 52 wound up on the takeup spool 58.

A tension mechanism for exerting a predetermined tension to the ink ribbon 52 is disposed on the other side (right end as viewed in FIG. 2) of the main frame 60 near the feed spool 57. The tension mechanism has a gear 66 mounted on a shaft 69 and in engagement with a gear 57C mounted on the shaft 57A of the feed spool 57, a compression spring 67 extended between the gear 66 and the main frame 67, and a retaining ring 68 for retaining the gear 66 biased by the compression spring 67 away from the main frame 60. The compression spring 67 presses the gear 66 against the retaining ring 68 to apply a resistance against the rotation of the gear 66. Since the gears 66 and the gear 57C mounted on the shaft 47A of the feed spool 57 are engaged, the resistance acts through the gear 66 on the feed spool 57 to exert a predetermined tension to the ink ribbon 52.

Pivot shafts 71A and 71B (only the shaft 71 is shown in FIG. 3) fixed to a head frame 70 supporting the thermal print head 51 are supported pivotally on one end of the main frame 60 on the side of the feed spool 57. The head frame 70 is able to swing relative to the main frame 60 on the pivot shafts 71A and 71B. Locking levers 72A and 72B are supported pivotally by shafts 73A and 73B on the free end, i.e., an end remote from the pivot shafts 71A and 71B, of the head frame 70. L-shaped locking hooks 72C and 72D are formed in lower end portions of the locking levers 72A and 72B, respectively. The head frame 70 is secured in place on the main frame 60 by bringing the locking hooks 72C and 72D into engagement with catching members 74A and 74B provided on the main frame 60, respectively. The ribbon guide 56 is supported on the head frame 70. When the head frame 70 is set in place on the main frame 60, the ribbon guide 56 presses the ink ribbon 52 down to tension the ink ribbon 52.

An operation for locking the head frame 70 in place on the main frame 60 will be described with reference to FIGS. 3 and 4. In FIG. 4, the main frame 60 is partly omitted to facilitate understanding the description.

The head frame 70 is kept at an upper open position, the respective shafts 57A, 57B, 58A and 58B of the feed spool 57 and the takeup spool 58 set in the bearings 61A, 61B, 62A and 62B, respectively, to install the ink ribbon 52 in the main frame 60 as shown in FIG. 3. Then the locking levers 72A and 72B are depressed to turn the head frame 70 on the pivot shafts 71A and 71B toward the main frame 60. Inclined portions 72E and 72F formed in the locking levers 72A and 72B strike against the upper ends 74C and 74D of the catching members 72C and 72D when the head frame 70 reaches a certain position and, as the head frame 70 is turned farther toward the main frame 60, the inclined portions 72E and 72F slide on the catching members 72C and 72D. Whereby, the locking lever 72A and 72B are turned clockwise, as viewed in FIG. 3. As the head frame 70 is turned farther downward, the locking levers are turned farther clockwise and, finally, the locking hooks engage with the catching members 74A and 74B of the main frame 60 to lock the head frame 70 in place on the main frame 60 as shown in FIG. 4.

In a state where the head frame 70 is set in place on the main frame 60, the thermal print head 51 is pressed against the platen 53 by the compression spring 55, the ink ribbon 52 is held between the thermal print head 51 and the platen 53, and the ribbon guide 56 supported on the head frame 70 presses the ink ribbon 52 down at positions on the opposite sides of the thermal print head 51.

A driven gear, not shown, is attached to one end of the platen 53 pressed through the ink ribbon 52 to the thermal print head 51 on the side of the ink ribbon winding mechanism (the left end as viewed in FIG. 2). The driving force of the platen driving motor 64 is transmitted through a transmission gear mechanism, not shown, to the driven gear. The platen 53 operates in cooperation with the thermal print head 51 for printing the recording sheet 41 and advancing the ink ribbon 52 and the recording sheet 41.

The printing operation of the printer will be described below with reference to FIG. 1. The lifting plate 44 on which the recording sheets 41 are stacked in the paper cassette 42 of the sheet feed unit 40 is tilted by the compression spring 45 so that the uppermost recording sheet 41 is pressed against the feed roller 43. When the feed roller 43 is rotated, the uppermost recording sheet 41 is fed from the paper cassette 42 to the register rollers 46. The register rollers 46 adjust the timing of delivering the recording sheet 41 fed thereto to the print unit 50, taking into consideration the printing operation of the print unit 50.

The recording sheet 41 delivered to the print unit 50 is held together with the ink ribbon 52 between the thermal print head 51 and the platen 53. When the thermal print head 51 is energized in this state, heated portions of the ink of the ink ribbon 52 melt and are transferred in ink dots to the recording sheet 41 to form characters and images on the recording sheet 41. The platen 53 is rotated at a predetermined rotating speed during the printing operation to advance the recording sheet 41 in synchronism with the energization of the thermal print head 51 according to print data. The printed recording sheet 41 is delivered to the delivery rollers 59, and then the delivery rollers 59 deliver the printed recording sheet 41 outside from the printer.

An ink ribbon winding operation for taking up the used ink ribbon 52 will be described with reference to FIG. 2. When the platen driving motor 64 is actuated to take up the used ink ribbon 52, the gear 65A of the slip clutch 65 is driven for rotation by the motor pinion 64B mounted on the output shaft 64A of the platen driving motor 64. The rotation of the gear 65A is transmitted directly to the plate 65D or through the compression spring 65B and the disk 65C to the plate 65D to rotate the gear 65E and the gear 58C mounted on the shaft 58B of the takeup spool 58 and in engagement with the gear 65E. Consequently, the takeup spool 58 is rotated to wind the used ink ribbon 52.

The operating speed of the platen driving motor 64 is determined so that the ink ribbon winding rate of the takeup spool 58 is always slightly higher than the ink ribbon feed rate of the platen 53. However, when the ink ribbon 52 is wound at an ink ribbon winding rate higher than the ink ribbon feed rate, at least the gear 65A of the slip clutch 65 slips relative to the plate 65D. Hence, the ink ribbon 52 can be wound up by a constant torque by a constant torque. Therefore, the ink ribbon 52 is wound at a fixed winding rate even if the diameter of a coil of the ink ribbon 52 wound on the takeup spool 58 varies as the ink ribbon 52 is wound up progressively on the takeup spool 58.

The feed spool 57 is rotated by a torque applied thereto by the ink ribbon 52 being unwound therefrom by the rotating platen 53. Since the gear 66 in engagement with the gear 57C mounted on the shaft 57A of the feed spool 57 is pressed against the retaining ring 68 by the compression spring 67, a predetermined resistance acts against the rotation of the feed spool 57 to restrain the feed spool 57 from free rotation, so that a constant tension is exerted always on the ink ribbon 52 while the ink ribbon 52 is being unwound from the feed spool 57.

In this prior art printer thus constructed, the ink ribbon winding mechanism is disposed near the takeup spool 58 on one side of the main frame 60 and the tension mechanism is disposed near the feed spool 57 on the other side of the main frame 60. Therefore, the tensile force acting on a portion of the ink ribbon 52 on the side of the winding mechanism is inevitably higher than that acting on a portion of the ink ribbon 52 on the side of the tension mechanism. Therefore, the tensions of one side portion of the ink ribbon 52 and the other side portion of the same (a right and a left side portion as viewed in FIG. 2) differ from each other. Consequently, the ink ribbon 52 is liable to be creased. When creases are formed in a portion of the ink ribbon 52 corresponding to the thermal print head 51, a pattern of the creases is printed on the recording sheet 41.

Such a problem may be solved by disposing two winding mechanisms on both sides of the takeup spool 58 and disposing two tension mechanisms on both sides of the feed spool 57, respectively, which, however, increases the cost of the printer significantly.

SUMMARY OF THE INVENTION

The present invention has been made to solve the foregoing and other problems. It is an object of the present invention to provide a printer capable of preventing the formation of creases in a portion of an ink ribbon corresponding to a print head and of printing characters and images in good print quality without forming streaks attributable to creases in the ink ribbon, without requiring additional costs.

According to one aspect of the present invention, a printer comprises an ink ribbon, a feed spool on which the ink ribbon is wound, and a takeup spool for taking up a used portion of the ink ribbon unwound from the feed spool and used for printing. A takeup spool driver is disposed on a first side of the printer for exerting a driving force on one end of the takeup spool to drive the takeup spool for rotation. A tension mechanism is disposed on a second side of the printer opposite the first side on which the takeup spool driver is disposed for exerting a resistance against the rotation of the feed spool to tension the ink ribbon. Finally, a print head is provided for printing a recording sheet by selectively heating portions of the ink ribbon. The length of a side portion of an ink ribbon transport path on the first side of the printer on which the takeup spool driver is disposed and that of a side portion of the ink ribbon transport path on the second side of the printer on which the tension mechanism is disposed are different from each other.

In this printer, the ink ribbon is extended between the feed spool and the takeup spool. The feed spool is disposed above the print head with respect to the direction of transportation of the ink ribbon, and the takeup spool is disposed below the print head with respect to the direction of transportation of the ink ribbon. The driving force of the takeup spool driver is applied to one end of the takeup spool to drive the takeup spool for rotation, and thereby the used ink ribbon is wound on the takeup spool. Since a resistance against the rotation of the feed spool is exerted on one end of the feed spool, the unused ink ribbon is fed at a predetermined tension.

A first side portion of the ink ribbon transport path on the first side of the printer and a second side portion of the ink ribbon transport path on the second side of the printer are different from each other to make tension distribution across a portion of the ink ribbon corresponding to the print head uniform. Therefore, creases that may be formed in the portion of the ink ribbon corresponding to the print head due the difference in tension between one side portion and the other side portion of the ink ribbon are not formed. Hence, characters can be printed in good print quality without forming streaks attributable to creases in the portion of the ink ribbon corresponding to the print head.

In this printer, the length of the ink ribbon transport path on one side of the printer on which the tension mechanism is disposed may be greater than that of the ink ribbon transport path on the other side of the printer on which the takeup spool driver is disposed to distribute tension uniformly across the ink ribbon in this printer.

The printer in accordance with the present invention further comprises a main frame rotatably supporting the feed spool and the takeup spool, a print head support frame supporting the print head and pivotally joined at one end thereof to the main frame, a locking mechanism attached to the print head support frame to lock the print head support frame in place on the main frame, and an ink ribbon guide mounted on the print head support frame so as to depress the ink ribbon so that the ink ribbon travels along an ink ribbon transport path. The position of a catching member, with which the locking mechanism engages, disposed on the main frame on one side of the main frame on which the tension mechanism is disposed may be lower than the position of another catching member, with which the locking mechanism engages, disposed on the main frame on the other side of the main frame on which the takeup spool driver is disposed.

In this printer, the main frame rotatably supports the feed spool and the takeup spool between which the ink ribbon is extended. The print head support frame is locked in place on the main frame. The ink ribbon guide is supported on the print head support frame so as to depress the ink ribbon at positions on the opposite sides of the print head with respect to the direction of travel of the ink ribbon. The position of catching member, with which the locking mechanism engages, disposed on the main frame on one side of the main frame on which the tension mechanism is disposed may be lower than the position of the other catching member, with which the locking mechanism engages, disposed on the main frame on the other side of the main frame on which the takeup spool driver is disposed. Therefore, the length of a portion of the ink ribbon transport path on one side of the ink ribbon is greater than that of a portion of the ink ribbon transport path on the other side of the ink ribbon. Hence, a high tension can be applied to the ink ribbon. Therefore, the tension can be substantially uniformly distributed across the ink ribbon.

The print head of the printer in accordance with the present invention may be a thermal print head provided with a plurality of heating elements arranged in a straight line parallel to the axes of the feed spool and the takeup spool. The locking mechanism may be locking levers pivotally supported on the print head support frame so as to engage with the catching members of the main frame. A shim may be disposed between the locking lever on the side of the tension mechanism and the corresponding catching member on the main frame.

Since position of engagement of the locking member on the side of the tension mechanism with the corresponding catching member is lowered by the thickness of the shim, the length of a portion of the ink ribbon transport path on the side of the locking lever on the side of the tension mechanism is greater than that of a portion of the ink ribbon on the other side. Therefore, a high tension can be applied to the ink ribbon. Hence, the tension can substantially uniformly be distributed across the ink ribbon.

As is apparent from the foregoing description, the printer in accordance with the present invention is capable of substantially uniformly distributing tension across a portion of the ink ribbon corresponding to the print head simply by moving one side portion of the ink ribbon and the other side portion of the ink ribbon along different ink ribbon transport paths, respectively. Consequently, creases due to the difference in tension between one side portion and the other side portion of the ink ribbon may not be formed in a portion of the ink ribbon corresponding to the print head. Hence, characters and images can be printed in good print quality without forming streaks in characters and images.

BRIEF DESCRIPTION OF THE DRAWINGS

Preferred embodiments of the present invention will be described in detail with reference to the accompanying drawings, wherein.

DETAILED DESCRIPTION OF PREFERRED EMBODIMENTS

Figure 1:
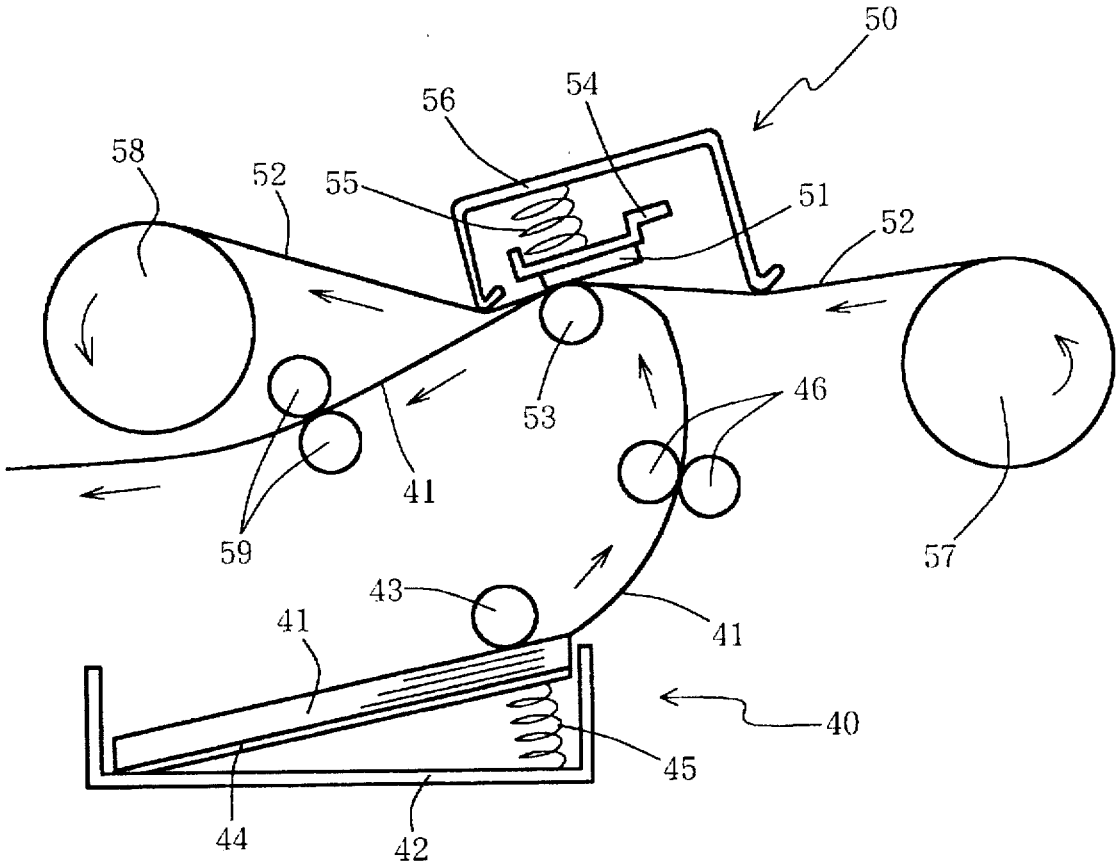
Fig.1 RELATED ART
FIG. 1 is a schematic side view of an essential portion of a prior art printer.
Figure 2:
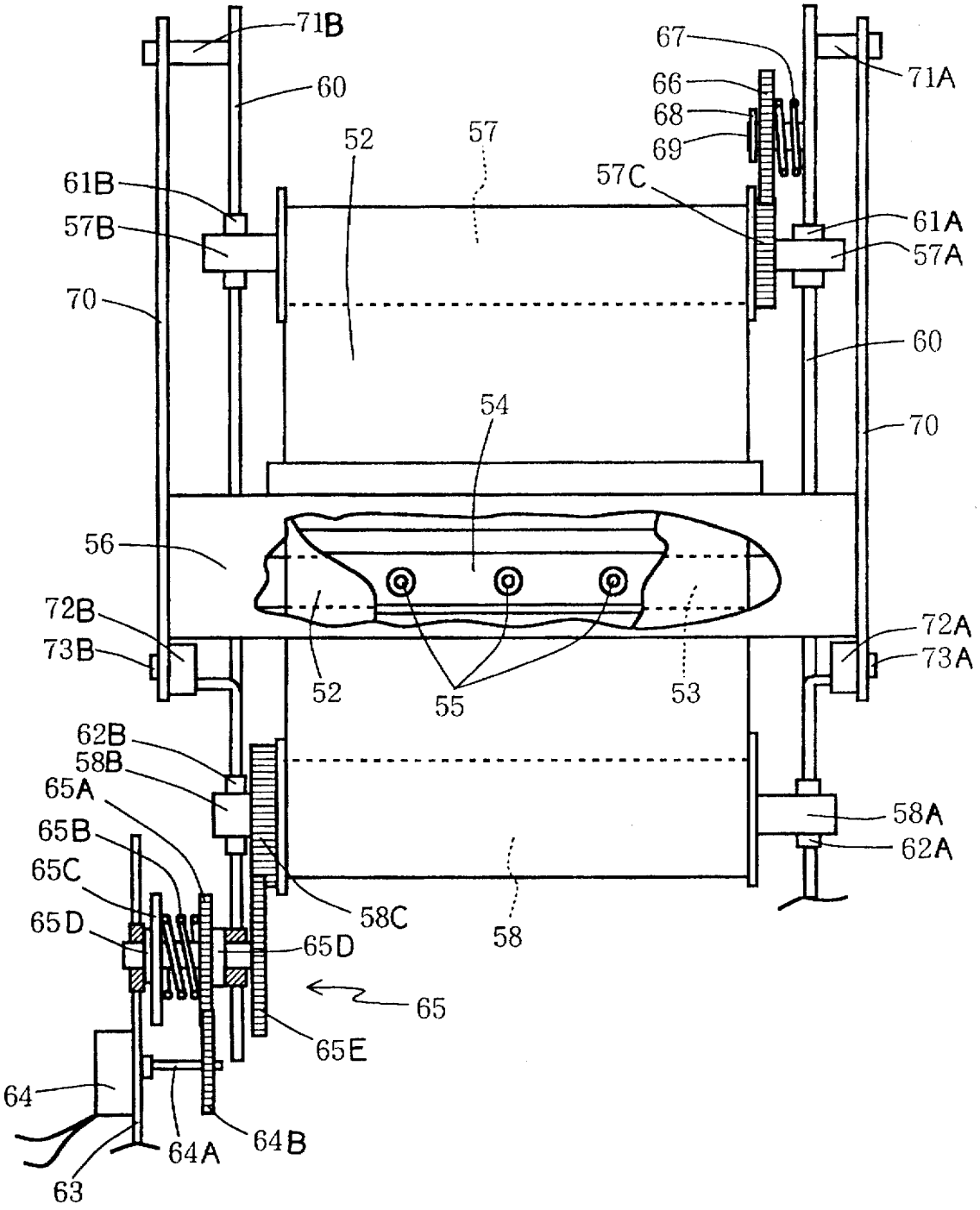
Fig.2 RELATED ART
FIG. 2 is a schematic, partly cutaway plan view of the printer of FIG. 1.
Figure 3:
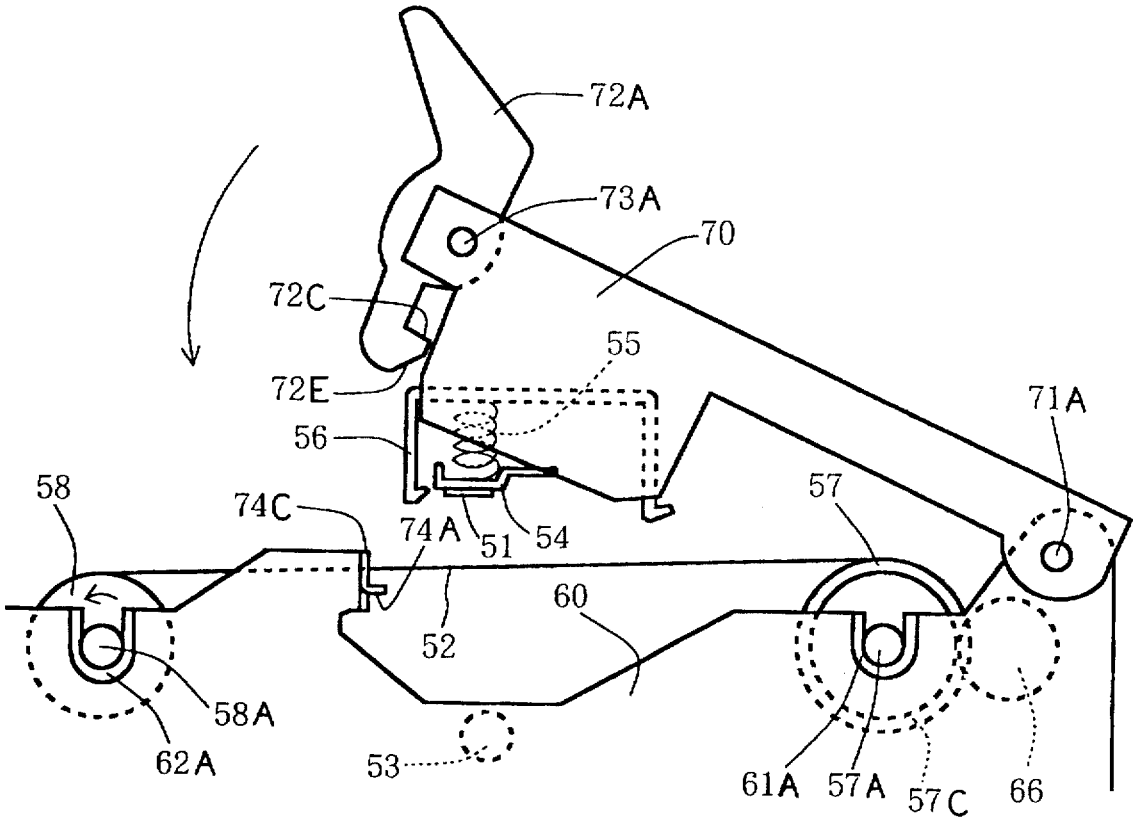
Fig.3 RELATED ART
FIG. 3 is a schematic side view of a print head support frame included in the printer of FIG. 1 at an operational position on a main frame.
Figure 4:
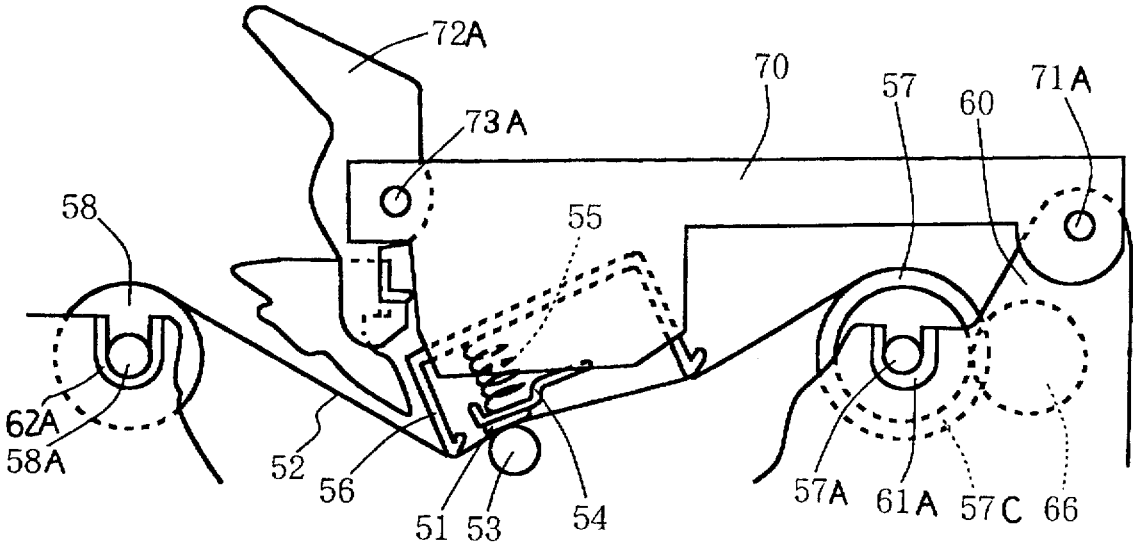
Fig.4 RELATED ART
FIG. 4 is a schematic side view of the print head support frame of FIG. 3 at an unoperational position away from the main frame.

A printer in the preferred embodiments according to the present invention will be described hereinafter with reference to FIGS. 5 to 7. Some parts of the printer embodying the present invention is similar in construction to the foregoing prior art printer, and hence parts like or corresponding to those of the foregoing prior art printer are designated by the same reference characters and the description thereof will be omitted.

Figure 5:
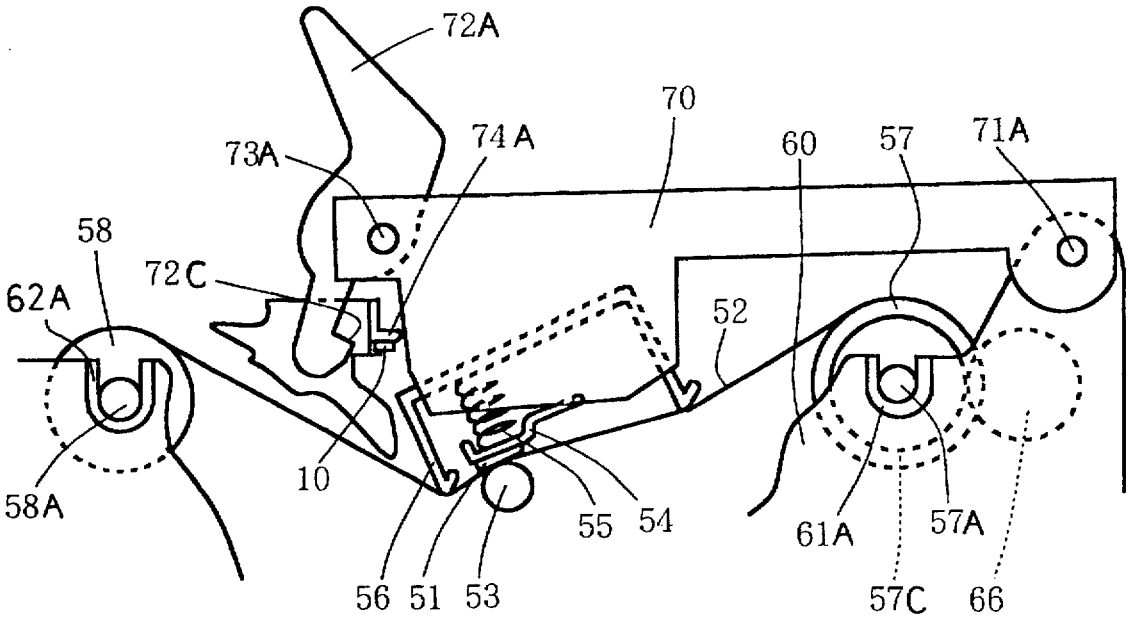
FIG. 5 is a schematic side view of a print head support frame included in a printer in a preferred embodiment according to the present invention at a position halfway to an operational position.

Referring to FIG. 5, showing a principal portion of the printer of the present invention in a schematic side view, catching members 74A and 74B are attached to the opposite sides of a main frame 60, respectively, and a 0.3 mm thick shim 10 is attached to the lower side of the catching member 74A on one side of the main frame 60 on which a tension mechanism is disposed. A shim is not attached to the catching member 74B on the other side of the main frame 60 on which a takeup spool driving mechanism is disposed. When a print head support frame 70 is locked in place on the main frame 60, one side portion of the print head support fame 70 corresponding to the catching member 74A to which the shim 10 is attached is lower than the other side portion of the same corresponding to the catching member 74B to which any shim is not attached.

The print head support frame 70 is turned from above the main frame 60 to an operational position on the main frame 60. A ribbon guide 56 for depressing an ink ribbon 52 is supported on the print head support frame 70. Therefore, when the position of a locking lever 72A (72B) in engagement with the catching member 74A (74B) relative to the main frame 60 is lowered, a side portion of the ink ribbon 52 on the side of the locking lever 72A (74B) is depressed further by the ink ribbon guide 56. So, the length of an ink ribbon transport path for this side portion of the ink ribbon 52 is increased and the tension of the same side portion of the ink ribbon is increased accordingly.

Figure 6:
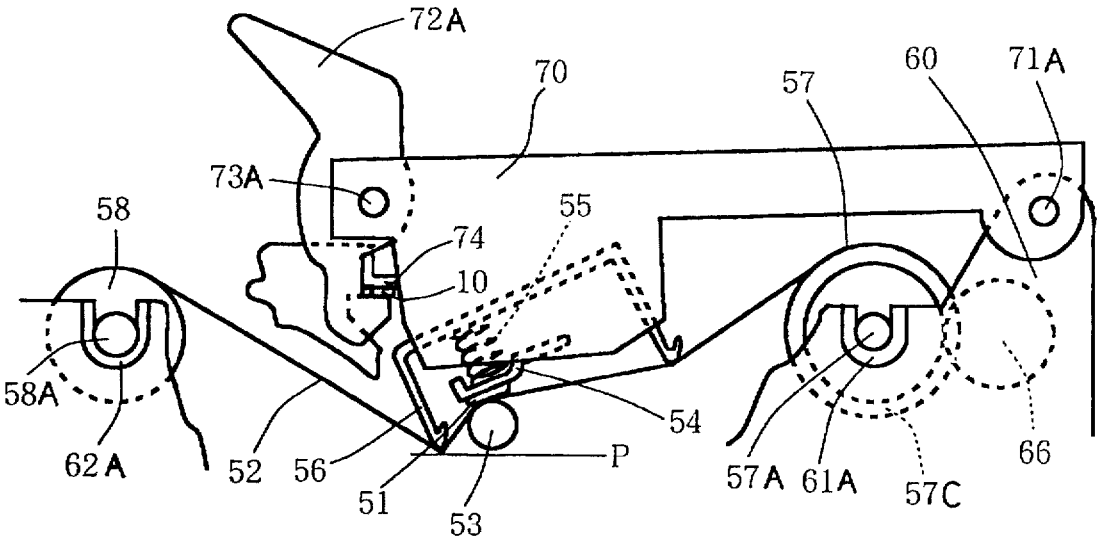
FIG. 6 is a schematic side view of the print head support frame at an operational position on the main frame, as viewed from one side the main frame on which a tension mechanism is disposed.
Figure 7:
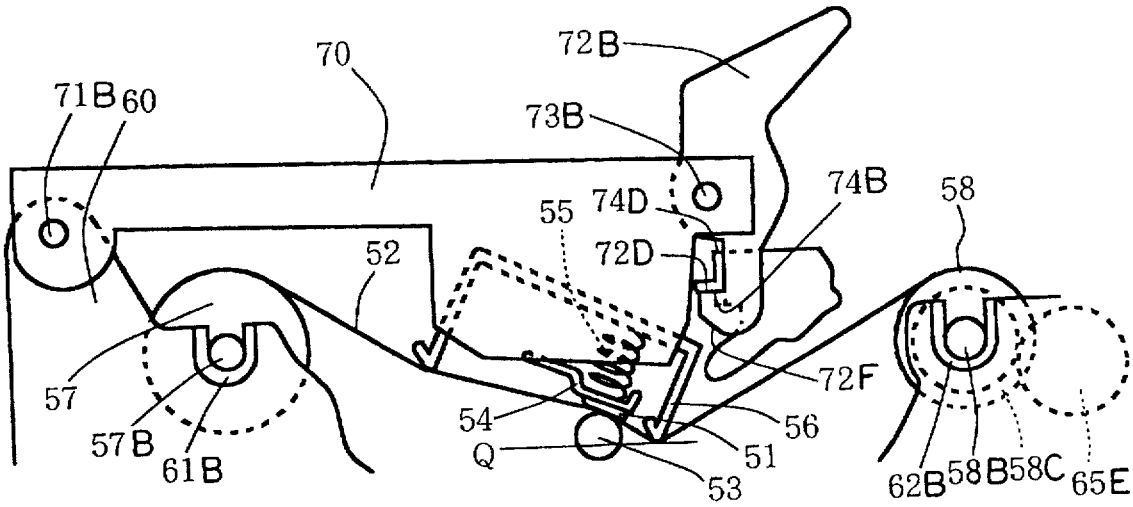
FIG. 7 is a schematic side view of the print head support frame at an operational position on the main frame, as viewed from the other side of the main frame on which a takeup spool driving mechanism is disposed.

FIGS. 6 and 7 show the print head support frame 70 locked in place on the main frame 60, in which FIG. 6 is a side view taken from one side of the main frame 60 on which the tension mechanism is disposed and FIG. 7 is a side view taken from the other side of the main frame 60 on which the takeup spool driving mechanism is disposed.

As shown in FIG. 7, a line Q corresponding to a portion of the lower edge of the ink ribbon guide 56 on one side of the main frame 60 extends slightly below the center axis of a platen 53. As shown in FIG. 6, a line P corresponding to a portion of the lower edge of the ink ribbon guide 56 on the other side of the main frame 60 extends below the platen 53. A side portion of the ink ribbon 52 on the side of the catching member 74A to which the shim 10 is attached is depressed deeper than a side portion of the ink ribbon 52 on the side of the catching member 74B to which a shim is not attached. Therefore, the ink ribbon transport path for the former side portion of the ink ribbon 52 is longer than that for the latter side portion of the ink ribbon 52. Hence, the tension of the former side portion of the ink ribbon 52 on the side of the tension mechanism is higher than that of the latter side portion of the ink ribbon 52 on the side of the takeup spool driving mechanism in a static state. Accordingly, the tension can uniformly be distributed across the ink ribbon 52 in a dynamic state in which the printer is in operation. Therefore creases are not formed in a portion of the ink ribbon 52 corresponding to the print head 51. Hence characters and images with no streaks can be printed in good print quality.

Since the printer in this embodiment needs only the shim 10 attached to the catching member 74A on the side of the tension means, the cost of the printer in this embodiment is far less than that of a printer requiring an additional takeup spool driving mechanism and an additional tension mechanism to distribute tension uniformly across the ink ribbon in the dynamic state. Further, the cost of the shim 10 is insignificant. The tension difference between one side portion and the other side portion of the ink ribbon 52 can easily be adjusted by using a shim of an appropriate thickness.

Although the invention has been described in its preferred embodiment, the present invention is not limited in its practical application to the embodiment specifically described and it is readily understood that many changes and modifications are possible.

Figure 8:
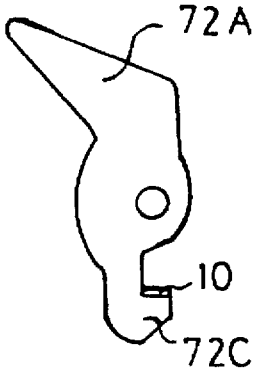
FIG. 8 is a side view of a modification of a locking lever included in the printer embodying the present invention.
Figure 9:
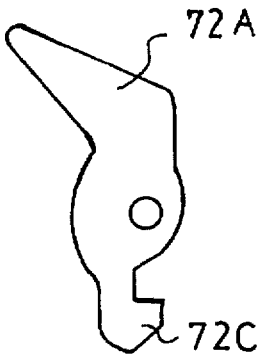
FIG. 9 is a side view of another modification of the locking lever included in the printer embodying the present invention.

For example, the shim 10 may be attached to the hook 72C of a locking lever 72A to be brought into engagement with the catching member 74A as shown in FIG. 8 instead of attaching the same to the catching member 74A. As shown in FIG. 9, the locking hook 72C of the locking lever 2A may be formed in dimensions equal to those of the locking hook 72C of the locking lever 72A including the shim 10 shown in FIG. 8. The distance between the axis of turning of the locking lever 72B on the side of the tension mechanism and the upper edge of the locking hook 72D of the same locking lever 72B may be increased by a length corresponding to the thickness of the shim 10 instead of attaching the shim 10 to the locking hook 72C of the locking lever 72A.

Figure 10:
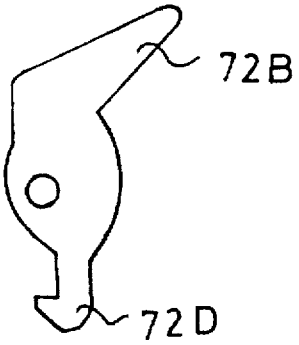
FIG. 10 is a side view of a further modification of the locking lever included in the printer embodying the present invention.
Figure 11:
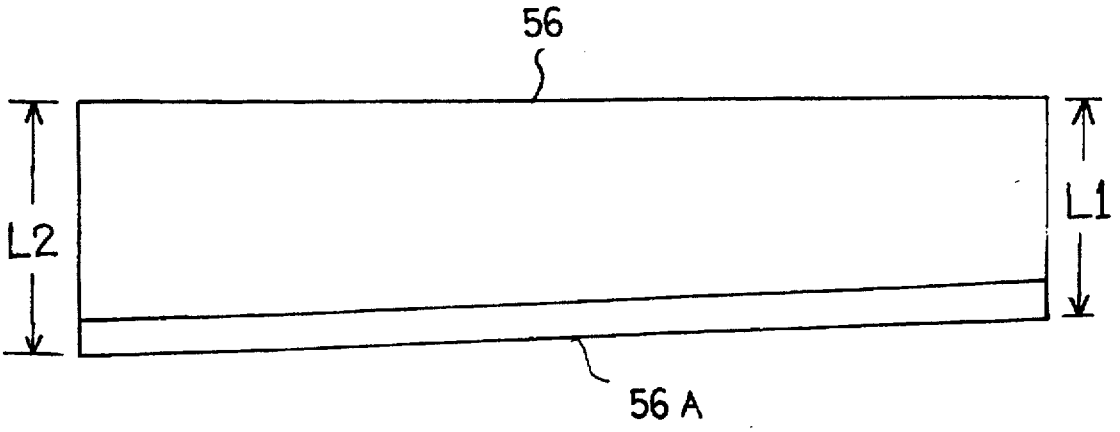
FIG. 11 is a modification of an ink ribbon guide included in the printer embodying the present invention.

Further, the catching member 74A on the side of the takeup spool driving mechanism may be disposed on a level below the level of the catching member 74B on the side of the tension mechanism as shown in FIG. 10. An ink ribbon guide 56 having an inclined working edge 56A as shown in FIG. 11 may also be employed where the width L1 of one edge is less than the width L2 of the other edge.

What is claimed is:

1. A printer comprising:

a frame;

a feed spool mounted on the frame, the feed spool having a first end and a second end, and an ink ribbon wound thereon;

a takeup spool mounted on the frame for taking up the ink ribbon, the takeup spool having a first end and a second end respectively aligned with the first end and the second end of the feed spool, wherein the ink ribbon extends from the feed spool to the takeup spool in a ribbon feeding path;

takeup spool driving means coupled to the takeup spool for driving the takeup spool to take up the ink ribbon;

feed tension means disposed at the second end of the feed spool for tensioning the ink ribbon when the ink ribbon is fed from the feed spool to the takeup spool;

recording medium support means for supporting a recording medium during printing disposed between the feed spool and the takeup spool in the ribbon feeding path;

printing means for printing an image on a recording medium disposed in the ribbon feeding path facing and biased toward the recording medium support means; and ink ribbon guide means disposed adjacent to the printing means for guiding the ink ribbon toward the recording medium support means including tension distributing means disposed between the second end of the feed spool and the second end of the takeup spool for distributing tension uniformly across the ink ribbon during feeding.

2. The printer of claim 1 wherein the tension distributing means tilts the ink ribbon guide means toward the second end of the feed spool such that a side of the ink ribbon guide means closest to the feed tension means second end is lower with respect to the recording medium support means than a side of the ink ribbon guide means closest to the takeup spool driving means.

3. The printer of claim 1 wherein the ink ribbon guide means is pivotally mounted to the frame and includes locking means for selectively locking the ink ribbon guide means to the frame, wherein the tension distributing means is connected with the locking means.

4. The printer of claim 3 wherein the locking means comprises a pair of locking levers, one locking lever disposed adjacent the first ends of the feed spool and the takeup spool and the other locking lever disposed adjacent the second ends of the feed spool and the takeup spool, and wherein the frame has a pair of catching members positioned to engage the locking levers, wherein the tension distributing means comprises a shim disposed between the locking lever and the catching member disposed adjacent the second ends.

5. The printer of claim 3 wherein the locking means comprises a pair of locking levers, one locking lever disposed adjacent the first ends of the feed spool and the takeup spool and the other locking lever disposed adjacent the second ends of the feed spool and the takeup spool, and wherein the frame has a pair of catching members positioned to engage the locking levers, wherein each locking lever is pivotally mounted about a common pivot axis and has a locking hook that abuts the catching member, the tension distributing means comprising an enlarged locking hook on the locking lever disposed adjacent the second ends.

6. The printer of claim 3 wherein the locking means comprises a pair of locking levers, one locking lever disposed adjacent the first ends of the feed spool and the takeup spool and the other locking lever disposed adjacent the second ends of the feed spool and the takeup spool, and wherein the frame has a pair of catching members positioned to engage the locking levers, wherein the locking lever adjacent the first ends is pivotally mounted about a first pivot axis and the locking lever adjacent the second ends is pivotally mounted about a second pivot axis lower than the first pivot axis with respect to the recording medium support means.

7. The printer of claim 3 wherein the locking means comprises a pair of locking levers, one locking lever disposed adjacent the first ends of the feed spool and the takeup spool and the other locking lever disposed adjacent the second ends of the feed spool and the takeup spool, and wherein the frame has a pair of catching members positioned to engage the locking levers, wherein the catching member adjacent the second ends is positioned lower than the catching member adjacent the first ends with respect to the recording medium support means.

8. The printer of claim 1 wherein the ink ribbon guide means is a generally U-shaped member with edges that press the ink ribbon down on a side of the recording medium support means adjacent to the feed spool and on an opposite side of the recording medium support means adjacent to the takeup spool.

9. The printer of claim 8 wherein the edge of the U-shaped member is inclined so as to press one side of the ink ribbon lower than the other side of the ink ribbon.

10. The printer of claim 1 wherein the ink ribbon has a first length measured between the first end of the feed spool and the first end of the takeup spool and a second length measured between the second end of the feed spool and the second end of the takeup spool, wherein the second length is greater than the first length.

11. The printer of claim 1 wherein the printing means is a thermal print head provided with a plurality of heating elements arranged in a straight line parallel to the feed spool and the takeup spool.

12. The printer of claim 1 wherein the takeup spool driving means is coupled to the first end of the takeup spool.

13. A printer comprising:

a frame having a first side and a second side;

printing means disposed between the first side and the second side;

a platen opposed to the printing means that supports a recording medium for printing;

an ink ribbon having a width extending between the first side and the second side and having a length;

feeding means attached to the ink ribbon for feeding the ribbon through a print path, the feeding means including feed driving means for driving the ink ribbon in a feeding direction and tensioning means for providing resistance to the feed driving means to tension the ink ribbon in the print path; and ribbon tension adjusting means for uniformly adjusting the tension in the ink ribbon during feeding, the ribbon tension adjusting means causing the length of the ink ribbon to be greater adjacent to the second side of the frame than the length adjacent to the first side of the frame.

14. The printer of claim 13 wherein the feeding means comprises a feed spool and a takeup spool, wherein the feed driving means comprises a takeup driver attached to one end of the takeup spool adjacent to the first side of the frame and the tensioning means comprises a tensioning element attached to one end of the feed spool adjacent to the second side of the frame.

15. The printer of claim 13 further comprising a ribbon guiding means disposed between the first side and the second side for pressing the ink ribbon against the platen, wherein the tension adjusting means tilts the ribbon guiding means toward the second side so as to press a side of the ink ribbon adjacent the second side to a lower position than a side of the ink ribbon adjacent the first side.

16. The printer of claim 15 wherein the ribbon guiding means is a U-shaped element that presses on the ink ribbon on both sides of the platen upstream and downstream of the print path.

17. The printer of claim 15 wherein the ribbon guiding means is pivotally attached to the frame and wherein a locking mechanism is attached to the ribbon guiding means and the frame for releasably locking the ribbon guiding means into a printing position, the ribbon tension adjusting means being a position adjusting element on the locking mechanism that tilts the ribbon guiding means to one side.

18. The printer of claim 17 wherein the locking mechanism comprises a locking lever and a catching member disposed on each side of the frame, the locking lever disposed on one of the ribbon guiding means and the frame and the catching member disposed on the other of the ribbon guiding means and the frame, and wherein the position adjusting element is one of the locking levers sized to lock one side of the ribbon guiding means at a lower position than the other side.

19. The printer of claim 17 wherein the locking mechanism comprises a locking lever and a catching member disposed on each side of the frame, the locking lever disposed on one of the ribbon guiding means and the frame and the catching member disposed on the other of the ribbon guiding means and the frame, and wherein the position adjusting element is one of the catching members positioned to lock one side of the ribbon guiding means at a lower position than the other side.

20. The printer of claim 17 wherein the locking mechanism comprises a locking lever and a catching member disposed on each side of the frame, the locking lever being disposed on one of the ribbon guiding means and the frame and the catching member being disposed on the other of the ribbon guiding means and the frame, and wherein the position adjusting element is one of the locking levers mounted lower than the other locking lever to lock one side of the ribbon guiding means at a lower position than the other side.

21. A printer comprising:

a frame having a first side and a second side;

a feed spool mounted between the first side and the second side of the frame, the feed spool having a first end and a second end corresponding to the first side and the second side respectively, and an ink ribbon wound thereon;

a takeup spool mounted between the first side and the second side of the frame for taking up the ink ribbon, the takeup spool having a first end and a second end respectively aligned with the first end and the second end of the feed spool, wherein the ink ribbon extends from the feed spool to the takeup spool in a ribbon feeding path;

a takeup spool driver disposed at the first end of the takeup spool for driving the takeup spool to take up the ink ribbon;

a tension mechanism disposed at the second end of the feed spool for tensioning the ink ribbon when the ink ribbon is fed from the feed spool to the takeup spool;

a platen extending between the first side and the second side of the frame that supports a recording medium during printing disposed between the feed spool and the takeup spool in the ribbon feeding path;

a print head support frame pivotally attached to the frame;

a print head spring mounted on the print head support frame that prints an image on a recording medium disposed in the ribbon feeding path facing and biased toward the platen;

an ink ribbon guide disposed adjacent to the print head that presses the ink ribbon downward toward the platen on both sides of the print head; and a first locking mechanism and a second locking mechanism that lock the print head support frame to the frame on the first side and the second side respectively, the first locking mechanism locking the print head support frame at a first position on the first side and the second locking mechanism locking the print head support frame at a second position on the second side, the second position being lower than the first position with respect to the platen.

22. The printer of claim 21 wherein the second locking mechanism includes a shim that adjusts the position with respect to the platen.

* * * * *